US006184760B1

(12) United States Patent
Wada et al.

(10) Patent No.: US 6,184,760 B1
(45) Date of Patent: Feb. 6, 2001

(54) HALF-WAVELENGTH RESONATOR TYPE HIGH FREQUENCY FILTER

(75) Inventors: Kouji Wada, Tokyo; Ikuo Awai, Ube; Toshio Ishizaki, Kobe, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/317,429

(22) Filed: May 24, 1999

(30) Foreign Application Priority Data

May 29, 1998 (JP) ..... 10-148957

(51) Int. Cl.[7] ..... H01P 1/20; H01P 7/00
(52) U.S. Cl. ..... 333/204; 333/219
(58) Field of Search ..... 333/204, 219

(56) References Cited

U.S. PATENT DOCUMENTS

| | | | | |
|---|---|---|---|---|
| 3,754,198 | * | 8/1973 | Anghel | 333/204 |
| 4,455,540 | * | 6/1984 | Henriot et al. | 333/202 |
| 4,641,116 | | 2/1987 | Shibata et al. . | |
| 4,992,759 | * | 2/1991 | Giraudeau et al. | 333/219 |
| 5,021,757 | * | 6/1991 | Kobayashi et al. | 333/205 |
| 5,990,765 | * | 11/1999 | Mansour et al. | 333/204 |

FOREIGN PATENT DOCUMENTS

| | | | |
|---|---|---|---|
| 2 704 984 | 5/1993 | (FR) . | |
| 56-116302 | 9/1981 | (JP) . | |
| 1224863 | * 11/1987 | (SU) | 333/204 |
| 1350703 | * 11/1987 | (SU) | 333/204 |

OTHER PUBLICATIONS

"Tapped–Line Interdigitial Bandpass Filters with Narrow Bandwidth Using Asymmetric Broadside Coupled Coplanar Waveguides"; XP 000643202; by Wada et al. pp. 487–492.
Kouji Wada, et al., "A New Concept of a Bandpass Filter with Transmission Zeros Based on Tap–Connected Half–Wavelength Resonators," Asia–Pacific Microwave Conference (1998), pp. 89–92.

* cited by examiner

*Primary Examiner*—Robert Pascal
*Assistant Examiner*—Patricia T. Nguyen
(74) *Attorney, Agent, or Firm*—Smith, Gambrell & Russell, LLP

(57) ABSTRACT

A half-wavelength resonator type high frequency filter has N half-wavelength resonators (where N is an integer not smaller than 2); an input terminal; an output terminal; first matching part for matching the first of the resonators to the input terminal; second matching part for matching the N-th of the resonators to the output terminal; and (N−1) interstage coupling part for coupling the resonators with one another, and wherein excitation positions of the first of the resonators and the N-th of the resonators are displaced from the center positions of the respective resonators toward an end thereof, and at least one of the interstage coupling part is electrically connected to its associated resonators at positions other than both ends thereof.

7 Claims, 6 Drawing Sheets

HALF-WAVELENGTH RESONATOR TYPE HIGH FREQUENCY FILTER

BACKGROUND OF THE INVENTION

1. Field of the Invention

The present invention relates to a half-wavelength resonator type high frequency filter, exemplified primarily by a dielectric filter used in wireless equipment such as a portable telephone.

2. Related Art of the Invention

In recent years, there has been an increasing demand for half-wavelength resonator type high frequency filters as compact and high performance filters that have superior selectively characteristics in order to achieve efficient utilization of frequencies in wireless communications. An example of a prior art half-wavelength resonator type high frequency filter will be described below with reference to drawing.

FIG. 6 shows the configuration of the prior art half-wavelength resonator type high frequency filter constructed using strip lines. In FIG. 6, reference numerals 41 and 42 are half-wavelength resonators. Reference numeral 43 is an input terminal, and 44 is an output terminal. Reference numeral 45 is an input matching circuit block Yt, 46 is an output matching circuit block Yt, and 47 is an interstage coupling capacitor Cg. The half-wavelength resonators 41 and 42 are each a strip line with both ends open, and the input matching circuit block 45Yt and output matching circuit block 46Yt are formed, for example, input and output coupling capacitors.

The operation of the thus constructed half-wavelength resonator type high frequency filter will be described below.

First, the resonators are excited at the midpoints of the respective strip lines, i.e., the dividing points between L1 and L2 and between L3 and L4, via the input and output matching circuit blocks which are, for example, input and output coupling capacitors. The interstage coupling capacitor Cg is electrically connected to both of the resonators at their resonator facets 48. The thus constructed filter exhibits a band pass characteristic with its pass band center frequency at the antiresonant frequency of the resonators and a transfer characteristic with attenuation poles formed at series-resonant frequencies of the L1 and L4 sections of the strip lines where they are equivalently grounded. In this case, if we consider only the fundamental mode, the number of attenuation poles is one per resonator.

In the above configuration, however, since each resonator resonates only at one specific frequency in the fundamental mode, the number of filter attenuation poles is limited to the number of resonators used. Further, the magnitude of attenuation is not sufficient. Another problem is that since there is a significant limitation on input/output matching, freedom in attenuation pole frequency control is limited.

SUMMARY OF THE INVENTION

In view of the above-outlined problems, it is an object of the present invention to provide a half-wavelength resonator type high frequency filter that permits the number of attenuation poles to be increased in relative terms, provides a sufficient degree of attenuation, and can freely control the filter's attenuation pole frequencies.

The 1st invention of the present invention is a half-wavelength resonator type high frequency filter comprising: N half-wavelength resonators (where N is an integer not smaller than 2); an input terminal; an output terminal; first matching means for matching the first of said resonators to said input terminal; second matching means for matching the N-th of said resonators to said output terminal; and (N−1) interstage coupling means for coupling said resonators with one another, and wherein excitation positions of said first of said resonators and said N-th of said resonators are displaced from the center positions of the respective resonators toward an end thereof, and at least one of said interstage coupling means is electrically connected to its associated resonators at positions other than both ends thereof.

The 2nd invention of the present invention is a half-wavelength resonator type high frequency filter comprising: two half-wavelength resonators; an input terminal; an output terminal; first matching means for matching the first of said resonators to said input terminal; and second matching means for matching the second of said resonators to said output terminal, and wherein said resonators are each shaped in the form of the letter L, and are disposed close together at positions substantially mirror-symmetric to each other so that bent portions of said resonators are electromagnetically coupled to each other.

The 3rd invention of the present invention is a half-wavelength resonator type high frequency filter comprising: N half-wavelength resonators with both ends open (where N is an integer not smaller than 2); an input terminal; an output terminal; first matching means for matching the first of said resonators to said input terminal; second matching means for matching the N-th of said resonators to said output terminal; and (N−1) interstage coupling means for coupling said resonators with one another, and wherein sections of each of said resonators, extending from said coupling point to the respective open ends thereof, series resonate, thereby generating two attenuation poles with each of said resonators.

DESCRIPTION OF THE REFERENCE NUMERALS

1, 2, 100. HALF-WAVELENGTH RESONATOR

3. INPUT TERMINAL

4. OUTPUT TERMINAL

5. INPUT MATCHING MEANS

6. OUTPUT MATCHING MEANS

7. INTERSTAGE COUPLING MEANS

200. GROUNDING ELECTRODE LAYER

PREFERRED EMBODIMENTS

A half-wavelength resonator type high frequency filter according to one embodiment of the present invention will be described below with reference to drawing.

Figure 1:
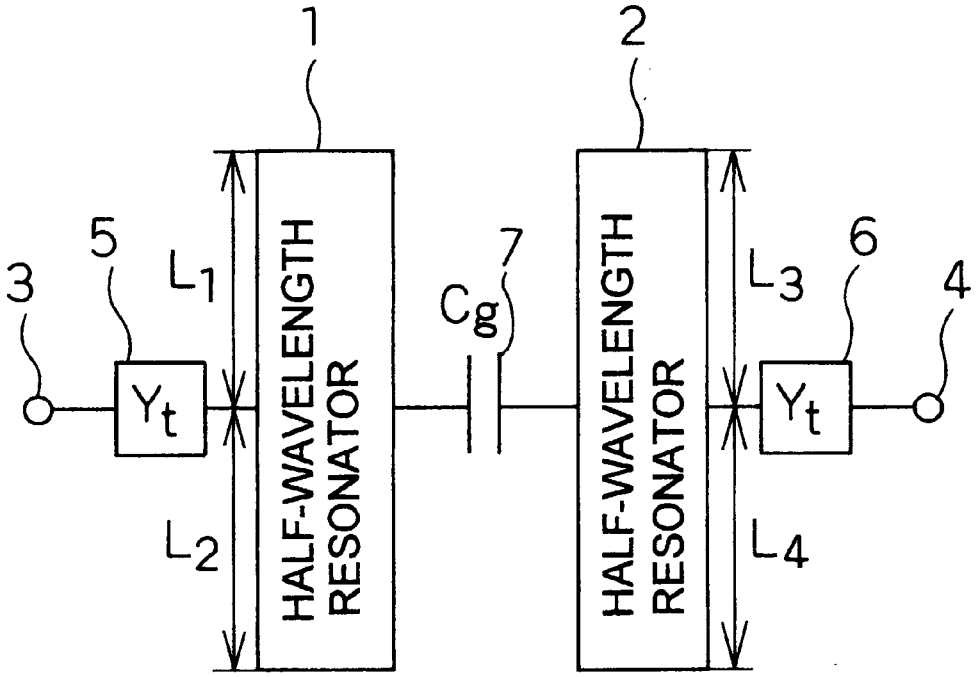
FIG. 1 is a diagram showing the circuit configuration of a half-wavelength resonator type high frequency filter according to one embodiment of the present invention.

FIG. 1 shows the configuration of the half-wavelength resonator type high frequency filter according to the embodiment of the present invention. In FIG. 1, reference numerals 1 and 2 are half-wavelength resonators. Reference numeral 3 is an input terminal, and 4 is an output terminal. Reference numeral 5 is an input matching means Yt, 6 is an output matching means Yt, and 7 is an interstage coupling means which is formed, for example, an interstage coupling capacitor Cg. The input and output terminals are tap-fed to the resonators via the input and output matching means. The interstage coupling capacitor Cg is electrically connected to both of the half-wavelength resonators 1 and 2 at positions other than both ends thereof. L1 and L2 indicate the distances from the excitation point of the first half-wavelength resonator to the respective ends thereof, and L3 and L4 indicate the distances from the excitation point of the second half-wavelength resonator to the respective ends thereof. In this embodiment, the relations $L1 \neq L2$, $L3 \neq L4$, $L2 \neq L4$, $L1 \neq L3$, and $L1+L2=L3+L4$ are satisfied.

Figure 2:
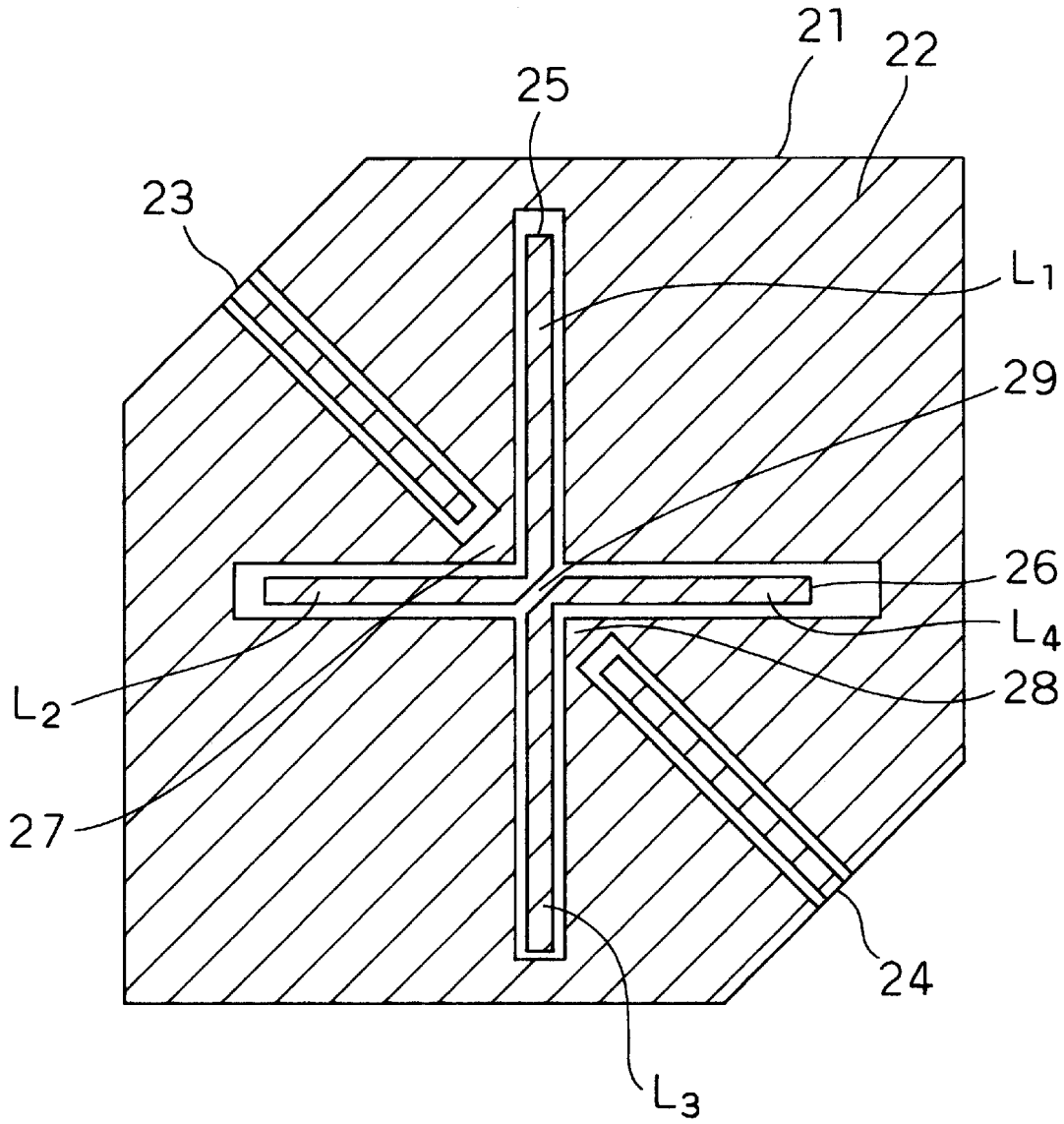
FIG. 2 is a diagram showing the structure of the half-wavelength resonator type high frequency filter according to one embodiment of the present invention.

FIG. 2 shows an example of a pattern diagram of the present embodiment constructed with coplanar waveguides (CPW). In this example, half-wavelength resonators 25 and 26 are TEM mode coplanar waveguide with both ends open, and are formed on a dielectric substrate 21 made of alumina or the like. Reference numeral 22 indicates a grounding pattern. Input and output matching circuit blocks are constructed, for example, from an input coupling capacitor 27, which is formed by a gap between an input transmission line 23 and the resonator 25, and an output coupling capacitor 28, which is formed by a gap between an output transmission line 24 and the resonator 26. Likewise, the interstage coupling capacitor Cg can be formed from an interstage coupling capacitor 29 formed by a gap between the waveguides. The interstage coupling capacitor Cg is electrically connected to the resonators 25 and 26 at intermediate points along the respective waveguides excluding both ends thereof, as earlier described. This example has the characteristic that the excitation point of each resonator is at the same position as the coupling point between the resonators.

The operation of the thus constructed half-wavelength resonator type high frequency filter will be described below with reference to FIGS. 1 and 2.

In the configuration of this embodiment, when the excitation point or the coupling point of the resonators is set slightly displaced from the center point, for example, each waveguide section of approximately one-quarter wavelength, extending from the excitation point to the end thereof, series resonates and generates an attenuation pole. Accordingly, two attenuation poles can be generated with each half-wavelength resonator.

The attenuation pole frequency can be set as desired by adjusting the connection point between the input matching means 5Yt and output matching means 6Yt and the interstage coupling means 7Cg. Input/output impedance matching can be accomplished with relative ease by selecting the configuration of the matching means and the way the excitation point is taken.

Figure 3:
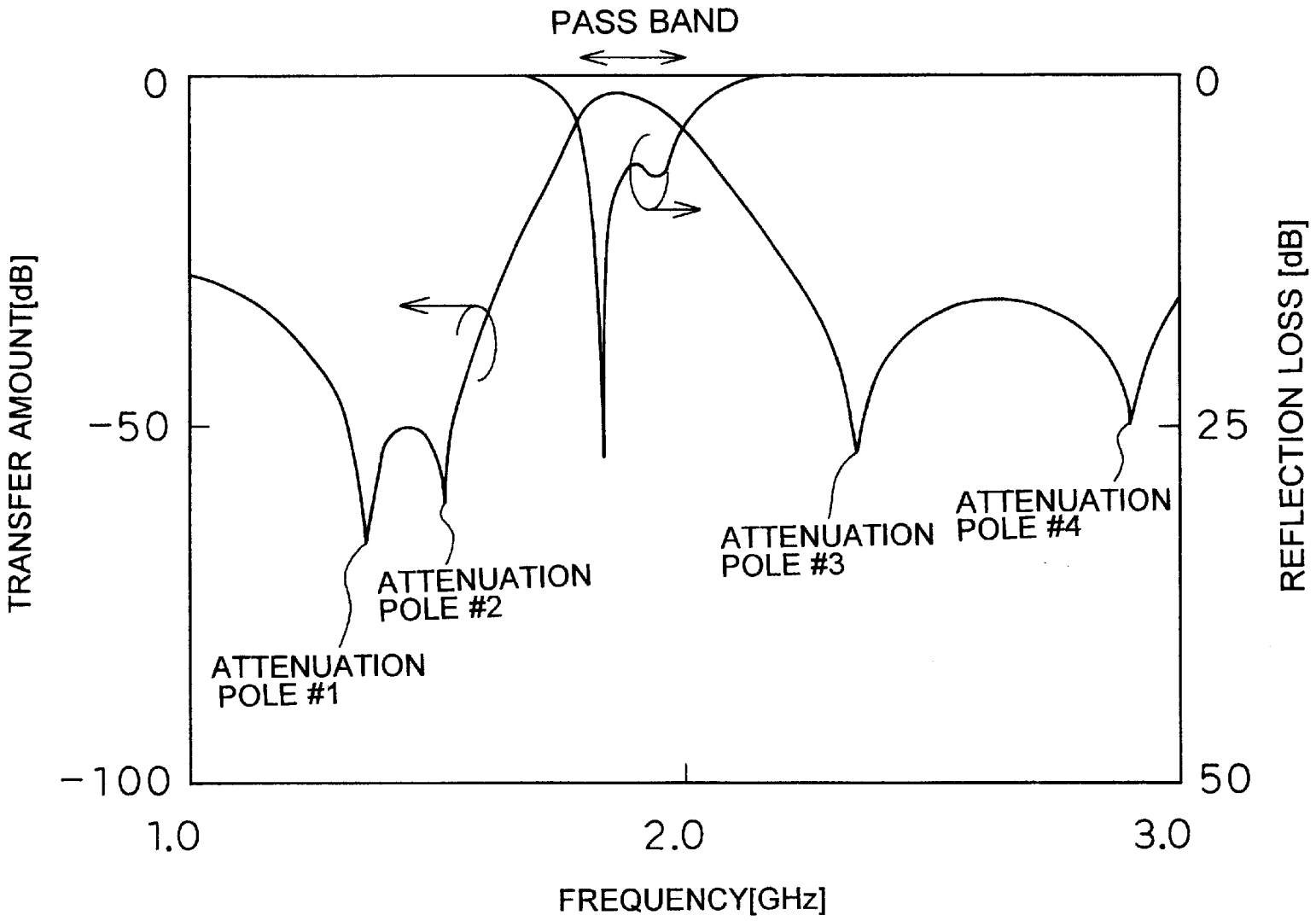
FIG. 3 is a characteristic diagram of the half-wavelength resonator type high frequency filter of FIG. 2.

FIG. 3 shows an example of the filter characteristic of the configuration of the present invention shown in FIG. 2. As shown by the graph of the transfer amount, four attenuation poles #1 to #4 are formed using the two-stage filter configuration. In this way, excellent selectivity characteristics can be obtained despite the compact size of the filter.

As described above, according to the present embodiment, by displacing the excitation point of each resonator from its center point toward one end thereof, and by connecting the interstage coupling means to the resonators at positions other than both ends thereof, a larger number of attenuation poles can be generated than the prior art configuration, and excellent selectivity characteristics can thus be obtained.

Figure 4:
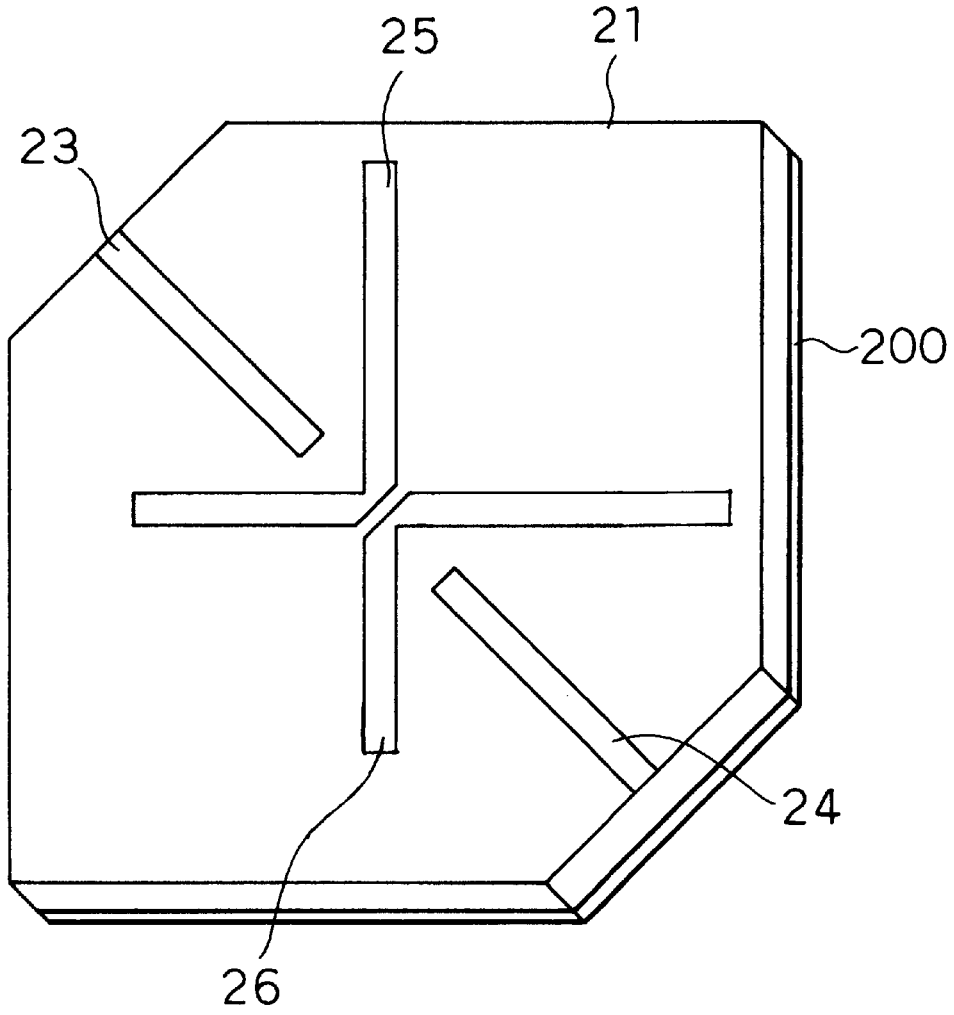
FIG. 4 is a diagram showing the structure of a half-wavelength resonator type high frequency filter in an embodiment different from the embodiment shown in FIG. 2.

FIG. 2 has shown coplanar waveguides, but it will be appreciated that the present invention can also be carried out using microstrip lines as shown in FIG. 4. In the figure, reference numeral 200 is a grounding electrode layer.

Figure 5:
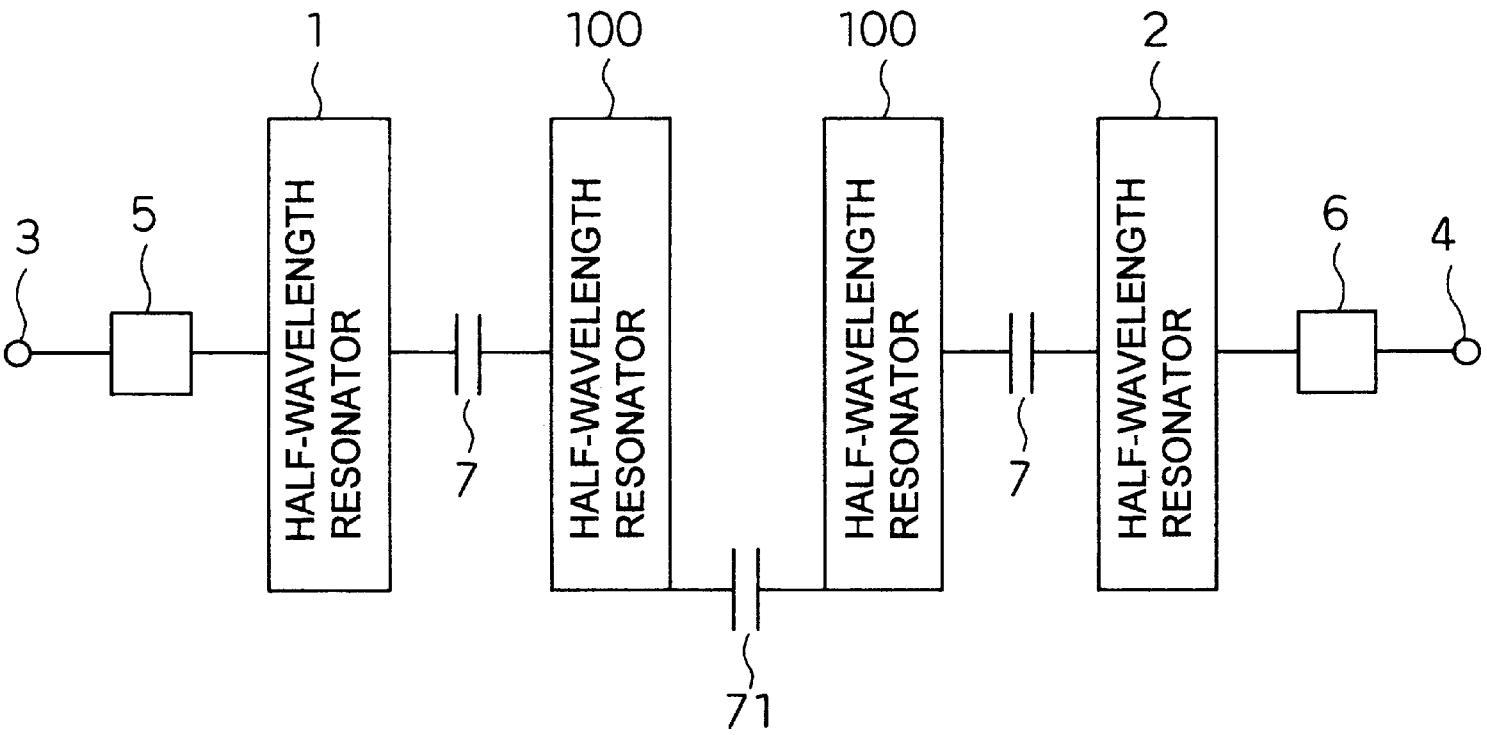
FIG. 5 is a diagram showing the circuit configuration of a half-wavelength resonator type high frequency filter in an embodiment different from the embodiment shown in FIG. 1.
Figure 6:
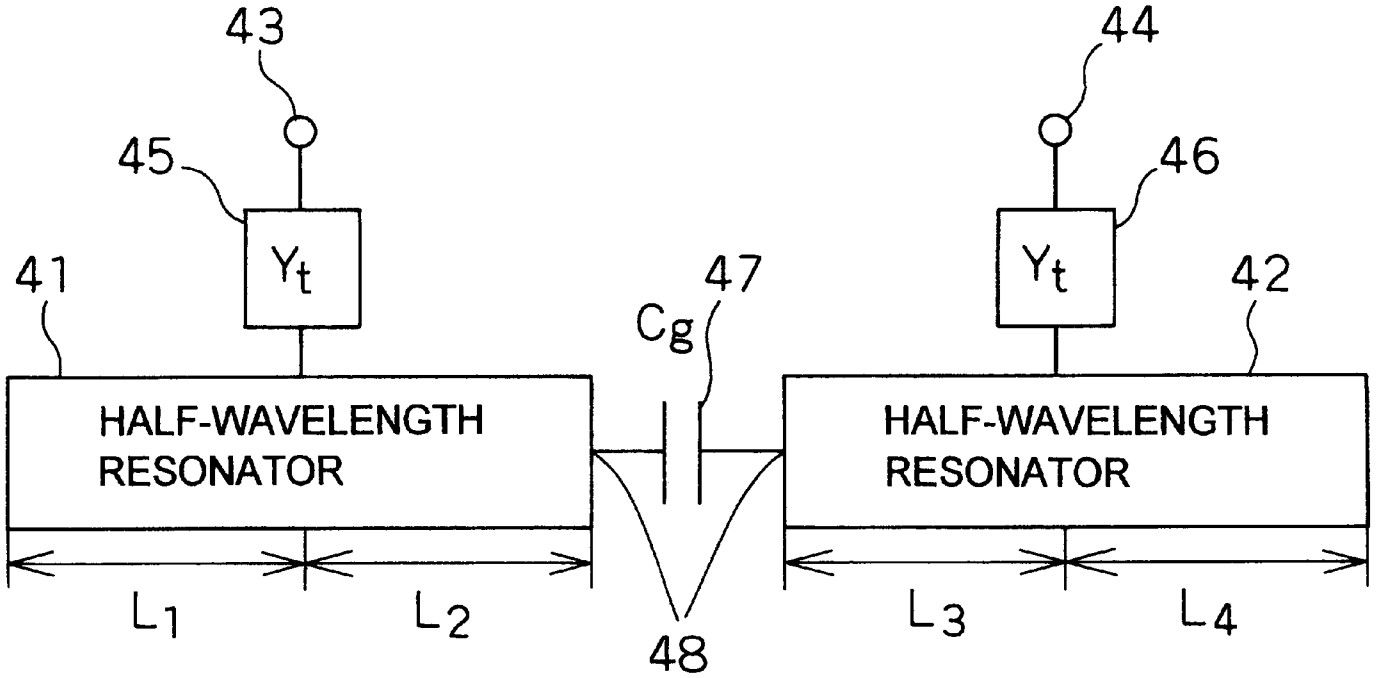
Fig. 6 PRIOR ART
FIG. 6 is a diagram showing the configuration of a half-wavelength resonator type high frequency filter according to the prior art.

FIG. 5 shows an example in which three or more resonators are used; in this example, not all the interstage coupling means are connected to the ends of their associated resonators 100, but one interstage coupling means 71 is connected to the ends of its associated resonators.

As described above, according to the present embodiment, a larger number of attenuation poles can be generated than the prior art configuration, and excellent selectivity characteristics can thus be obtained.

Further, by forming the matching means from coupling capacitors, a high frequency filter having attenuation poles can be constructed with simple configuration.

By configuring the excitation means as a tap feeding type, the configuration of the high frequency filter having attenuation poles can be further simplified.

By constructing the resonators as TEM resonators with both ends open, the fabrication of the filter can be made easier.

The magnitude of the attenuation poles can be made sufficiently large.

The attenuation poles can be generated at desired frequencies, and excellent selectivity characteristics can be obtained with simple configuration.

What is claimed is:

1. A half-wavelength resonator type high frequency filter comprising:

N half-wavelength resonators, wherein N is an integer $\geqq 2$;

an input terminal;

an output terminal;

first matching means for matching the first of said resonators to said input terminal;

second matching means for matching the N-th of said resonators to said output terminal; and (N−1) interstage coupling means for coupling said resonators with one another, wherein excitation positions of said first of said resonators and N-th of said resonators are displaced from the center positions of the respective resonators toward an end thereof, at least one of said interstage coupling means is electrically connected to its associated resonators at positions other than both ends thereof, and said input and output terminals are tap-fed to said resonators via said first and second matching means.

2. A half-wavelength resonator type high frequency filter according to claim 1, wherein said first matching means for matching said first input terminal and said second matching means for matching said output terminal are each formed from a coupling capacitor.

3. A half-wavelength resonator type high frequency filter according to claim 1, wherein said half-wavelength resonators are TEM resonators with both ends open.

4. A half-wavelength resonator type high frequency filter comprising:

two half-wavelength resonators;

an input terminal;

an output terminal;

first matching means for matching the first of said resonators to said input terminal; and second matching means for matching the second of said resonators to said output terminal, wherein said resonators are each shaped in the form of the letter L, and are disposed close together at positions substantially mirror-symmetric to each other so that bent portions of said resonators are electromagnetically coupled to each other, and said input and output terminals are tap-fed to said resonators via said first and second matching means.

5. A half-wavelength resonator type high frequency filter according to claim 4, wherein each of said matching means is made in the form of a strip with one end thereof positioned in close proximity to the bent portion of its corresponding one of said resonators.

6. A half-wavelength resonator type high frequency filter according to claim 5, wherein the length of one arm of said L shape is different from the length of the other arm thereof.

7. A half-wavelength resonator type high frequency filter comprising:

N half-wavelength resonators with both ends open, wherein N is an integer $\geqq 2$;

an input terminal;

an output terminal;

first matching means for matching the first of said resonators to said input terminal;

second matching means for matching the N-th of said resonators to said output terminal;

and (N−1) interstage coupling means for coupling said resonators with one another, wherein sections of each of said resonators, extending from said coupling point to the respective open ends thereof, series resonate, thereby generating two attenuation poles with each of said resonators, and said input and output terminals are tap-fed to said resonators via said first and second matching means.

* * * * *